United States Patent [19]

Britton

[11] 4,237,561

[45] Dec. 9, 1980

[54] SEDENTARY BATHING SYSTEM

[76] Inventor: Milton Britton, 39 Forest St., Boston, Mass. 02119

[21] Appl. No.: 51,249

[22] Filed: Jun. 22, 1979

[51] Int. Cl.[3] ..... A47K 3/22; A61H 33/00; A47K 3/12

[52] U.S. Cl. ..... 4/546; 579/549, 585/568; 128/366

[58] Field of Search ..... 4/145, 146, 148, 149, 4/150, 152, 153, 154, 159, 173 R, 175, 177 R, 177 A, 177 CW, 254, 185 R, 185 S, 185 AB, 185 B, 189, 190, 147, 155, 4, 5, 185 HB, 185 F; 312/228; 128/366, 369, 371, 376, 377

[56] References Cited

U.S. PATENT DOCUMENTS

| | | | |
|---|---|---|---|
| 1,017,700 | 2/1912 | Strock | 4/185 S X |
| 1,406,779 | 2/1922 | Thibadure | 4/185 S |
| 2,287,419 | 6/1942 | DuVal | 4/146 |
| 2,306,934 | 12/1942 | Cade | 4/173 R |
| 2,713,174 | 7/1955 | Merlin et al. | 4/185 S |
| 3,013,280 | 12/1961 | Coffman et al. | 4/159 |
| 3,040,335 | 6/1962 | Gellman | 4/185 S X |
| 3,447,166 | 6/1969 | Gordon | 4/146 X |
| 3,562,821 | 2/1971 | Queen | 4/146 |
| 3,587,118 | 6/1971 | Compton | 4/146 |
| 3,995,330 | 12/1976 | Meyers | 4/146 |
| 4,055,863 | 11/1977 | Duval | 4/185 AB |
| 4,099,272 | 7/1978 | Sowder | 4/150 X |
| 4,112,524 | 9/1978 | Johansson | 4/185 S X |
| 4,160,292 | 7/1979 | Kuether | 4/185 S X |

*Primary Examiner*—Stuart S. Levy
*Attorney, Agent, or Firm*—Jerry Cohen

[57] ABSTRACT

A sedentary bathing system utilizes a seat and back reclinably mounted to it so as to form a chair; associated with the chair is a perforated pipe for spraying water on a subject sitting in the chair.

1 Claim, 2 Drawing Figures

SEDENTARY BATHING SYSTEM

BACKGROUND OF THE INVENTION

Bathing is traditionally performed seated in a tub or standing in a shower. The present invention relates to a bathing system in which the subject receives a shower while seated.

SUMMARY OF THE INVENTION

It is an object of the present invention to provide a system for bathing a person while seated.

It is also an object of the invention to provide a system for bathing a person with a shower spray.

It is a further object of the present invention to provide a system for bathing a person whose incapacities prevent self-bathing.

It is a further object of the invention to provide a movable sedentary bathing system.

These and other objects of the invention are achieved by providing a seat; a back reclinably mounted to the seat, so as to form a chair; and a perforated pipe, associated with the chair, for spraying water on a subject sitting in the chair. In a preferred embodiment of the invention, there is also provided a base so as to form a shallow trough in which the chair is placed; a rod is mounted above the base for receiving shower curtain; and the base is provided with a drain.

DESCRIPTION OF SPECIFIC EMBODIMENTS

Figure 1:
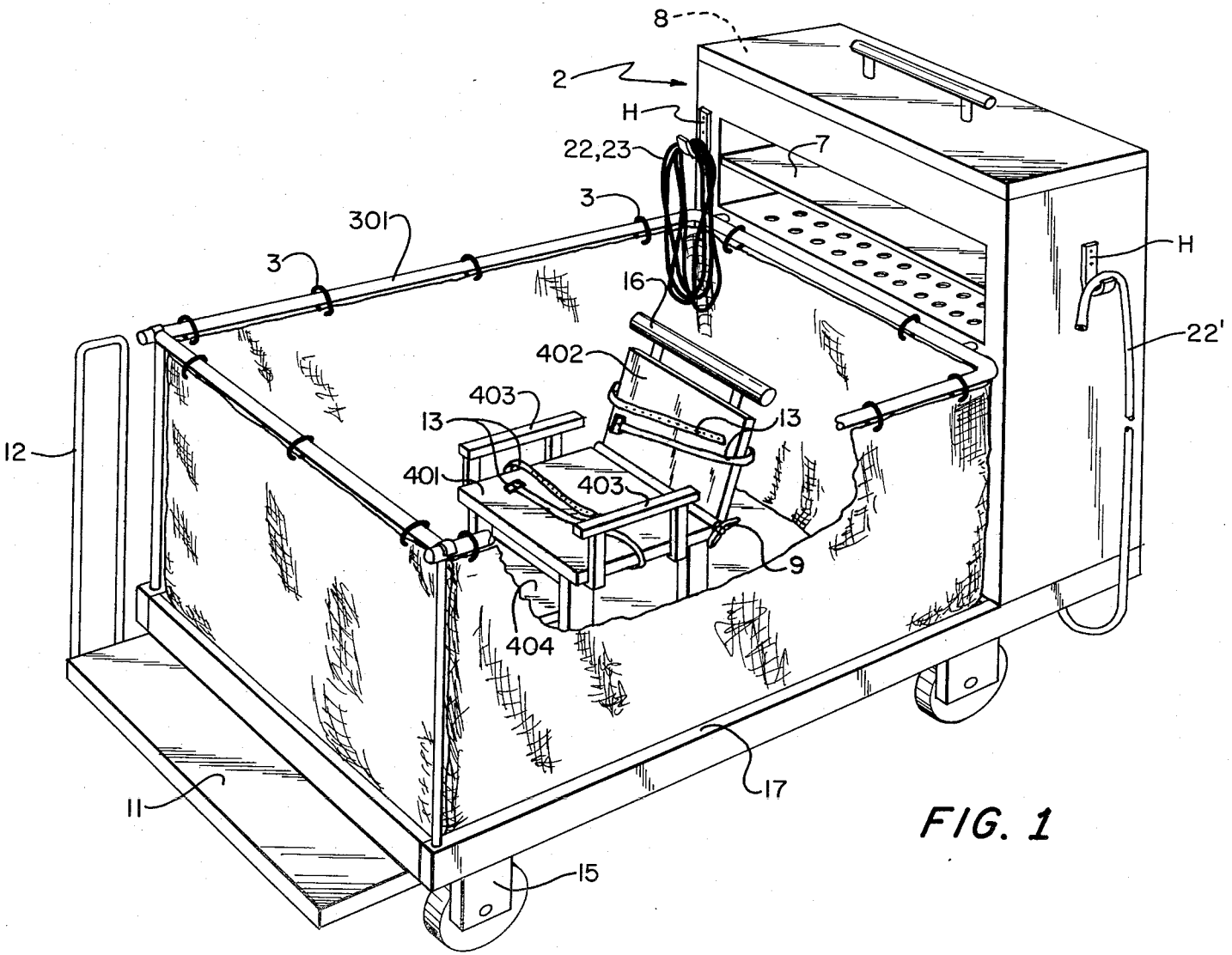
Figure 2:
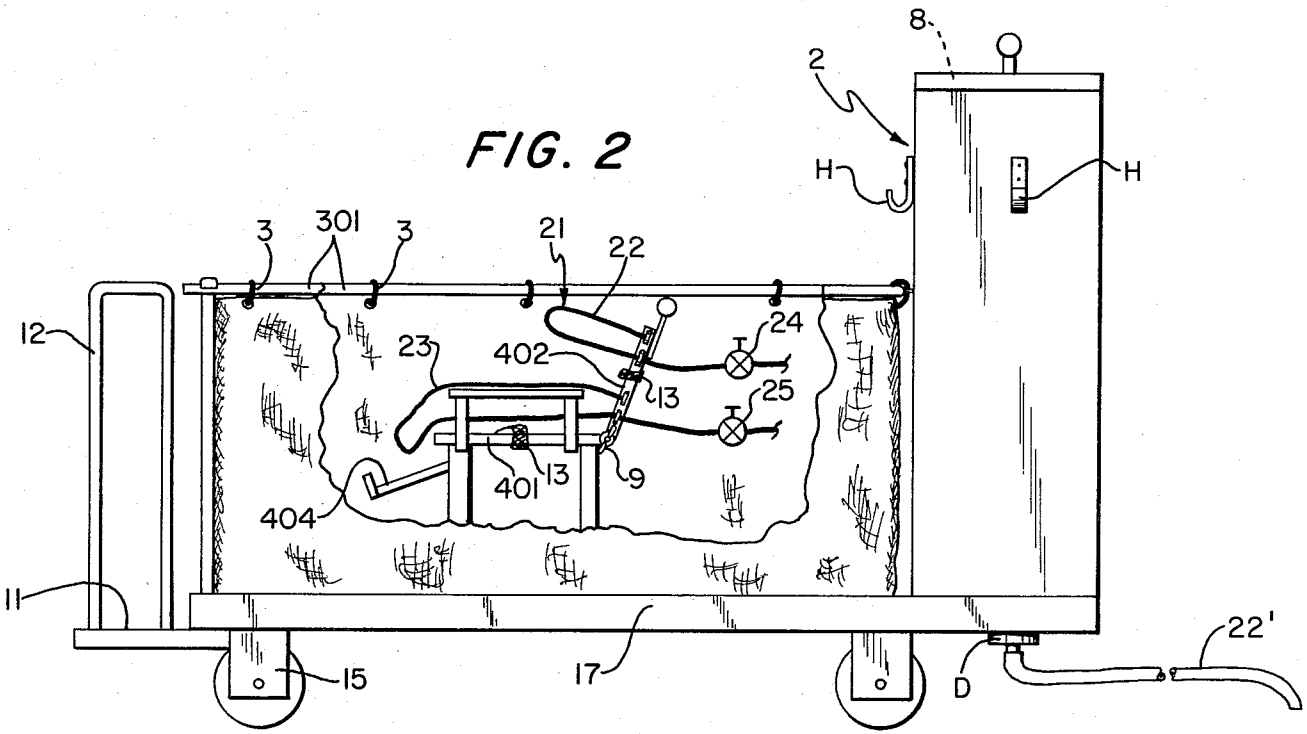

These and other objects and features of the invention will be more readily understood from a consideration of the following detailed description taken with the accompanyiing drawings, in which FIG. 1 is a perspective view of a preferred embodiment of the system; and FIG. 2 is another view of the same embodiment.

Shown in FIG. 1 is the chair, which includes seat 401, back 402, arms 403, and footrest 404. Attached to the chair are supporting belts 13 as well as headrest 16. The supporting belts 13 enhance the safety features of this embodiment by helping to restrain undesired movement of the user.

The chair is on a base 17 in the shape of a trough. Above the base are mounted a set of rods 301 for mounting a shower curtain 3 by means of pegs or hooks. The trough is provided with a conventional drain (not shown). Four wheels are mounted on the lower side of the base by means of supports 15. At the foot of the base is a step 11 and rail 12 to permit easy entry into the system.

At the head of the system is a cabinet 2. The cabinet has a top shelf 8 that can be used for carrying toiletries. Inside the cabinet is a second shelf 7 of conventional solid design. Below shelf 7 is a third shelf having holes to permit drip-drying of items placed thereon. The shelf is mounted over the base 17 so that the base receives water from items on the shelf.

The angle of the back 402 is adjusted by means of a wing nut-bolt-slot system 9.

Another view of the embodiment shown in FIG. 1 is shown in FIG. 2. In FIG. 2 can be seen clearly the items shown in FIG. 1, the numbering of which has been retained in this Figure. Shown also are the perforated pipe 21 that can be connected to conventional warm water sources. The perforated pipe is typically a flexible hose having perforations. One source of warm water may be water that has flown through a thermostatic cold and hot water mixing valve. The perforated pipe is is two sections. The head spray section 22 and a body spray section 23. Valve 24 controls whether the head spray section receives water and valve 25 controls whether any of the sections receive water.

Hooks H are provided on the apparatus for storing hoses 22 and 23, used within the bathing apparatus and a drain hose 22', the latter operating out of a drain plug D when the apparatus is in use for bathing.

Accordingly, while the invention has been described with particular reference to specific embodiments thereof in the interest of complete definiteness, it would be understood that it may be embodied in a variety of forms diverse from those shown and described without departing from the spirit and scope of the invention as defined by the following claims.

What is claimed is:

1. A movable sedentary bathing system, comprising (a) a seat;

(b) a pair of arm rests mounted on the seat;

(c) a back reclinably mounted to the seat so as to form, in cooperation therewith, a chair;

(d) a head rest mounted on the back;

(e) a supporting belt attached to the chair for removably retaining a subject sitting in the chair;

(f) perforated pipe, means secured to the back of said chair, for spraying water on a subject sitting in the chair, such perforated pipe means having a head spray section and a body spray section;

(g) a valve, in series with the head spray section of the perforated pipe, to control whether water is provided to the head spray section of the perforated pipe;

(h) a base, shaped so as to form a shallow trough and in which the chair is placed, and having a head and a foot;

(i) a rod, mounted above the base, said rod receiving hooks and a shower curtain with the bottom of said shower curtain extending into said trough;

(j) a drain mounted in the base;

(k) a step, mounted at the foot of the base, for assisting a subject's entrance into the system;

(l) a hand rail, also mounted at the foot of the base, as an aid in supporting a subject utilizing the step;

(m) at least four wheels mounted underneath the base to facilitate movement of the system from one location to another;

(n) a cabinet, affixed at the head of the base, and having a shelf with drainage holes located over the trough so as to permit drip drying of articles placed on the shelf; and (o) said rod being secured to both said cabinet and said base with said rod being located at substantially the same height as said shelf.

* * * * *